US010457063B2

(12) United States Patent
Matsuo

(10) Patent No.: US 10,457,063 B2
(45) Date of Patent: Oct. 29, 2019

(54) INK JET HEAD AND INK JET RECORDING APPARATUS

(71) Applicant: KONICA MINOLTA, INC., Chiyoda-ku, Tokyo (JP)

(72) Inventor: Takashi Matsuo, Suita (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/760,793

(22) PCT Filed: Sep. 12, 2016

(86) PCT No.: PCT/JP2016/076734

§ 371 (c)(1),
(2) Date: Mar. 16, 2018

(87) PCT Pub. No.: WO2017/047533

PCT Pub. Date: Mar. 23, 2017

(65) Prior Publication Data

US 2019/0047286 A1 Feb. 14, 2019

(30) Foreign Application Priority Data

Sep. 18, 2015 (JP) ..... 2015-184585

(51) Int. Cl.
*B41J 2/18* (2006.01)
*B41J 2/14* (2006.01)
*B41J 2/055* (2006.01)

(52) U.S. Cl.
CPC ..... *B41J 2/18* (2013.01); *B41J 2/055* (2013.01); *B41J 2/14* (2013.01); *B41J 2/14233* (2013.01);
(Continued)

(58) Field of Classification Search
CPC ..... B41J 2/18; B41J 2/19; B41J 2/055; B41J 2202/07; B41J 2/14233; B41J 2002/14306
See application file for complete search history.

(56) References Cited

U.S. PATENT DOCUMENTS

2008/0079759 A1 4/2008 Nagashima
2010/0075050 A1 3/2010 Tojo et al.
(Continued)

FOREIGN PATENT DOCUMENTS

CN 105383176 A 3/2016
EP 2990205 A2 3/2016
(Continued)

OTHER PUBLICATIONS

Extended European Search Report corresponding to Application No. 16846404.8-1019/3351388 PCT/JP2016076734; dated Aug. 28, 2018.
(Continued)

*Primary Examiner* — Geoffrey S Mruk
(74) *Attorney, Agent, or Firm* — Cantor Colburn LLP

(57) ABSTRACT

An object of the present invention is to provide an ink jet head and the like that are small, are capable of achieving a higher resolution, increasing ejection stability, and lowering production costs, and include flow paths capable of circulating ink. An ink jet head of the present invention includes: a head chip including nozzles, pressure chambers that communicate with the respective nozzles, piezoelectric elements that correspond to the respective pressure chambers, discrete circulation flow paths that branch from ink flow paths extending from inlets of the pressure chambers to outlets of the nozzles and are capable of discharging the ink in the pressure chambers, and a common circulation flow path with which at least two of the discrete circulation flow paths communicate; and a common supply liquid chamber that is provided on the upper surface of the head chip, and stores the ink to be commonly supplied to the respective pressure chambers through ink supply holes formed in the upper surface of the head chip.

22 Claims, 8 Drawing Sheets

(52) U.S. Cl.
CPC ..... *B41J 2002/14306* (2013.01); *B41J 2002/14419* (2013.01); *B41J 2002/14491* (2013.01); *B41J 2202/12* (2013.01); *B41J 2202/18* (2013.01)

(56) References Cited

U.S. PATENT DOCUMENTS

| | | | |
|---|---|---|---|
| 2011/0007117 | A1 | 1/2011 | Bibl et al. |
| 2015/0124019 | A1 | 5/2015 | Cruz-Uribe et al. |

FOREIGN PATENT DOCUMENTS

| | | | | | |
|---|---|---|---|---|---|
| JP | 2008-290292 | | * | 12/2008 | ..... B41J 2/175 |
| JP | 5563332 | B2 | | 7/2014 | |
| JP | 2015150882 | A | | 8/2015 | |

OTHER PUBLICATIONS

International Search Report corresponding to Application No. PCT/JP2016/076734; dated Nov. 29, 2016.
Written Opinion of the International Searching Authority corresponding to Application No. PCT/JP2016/076734; dated Nov. 29, 2016.
SIPO First Office Action corresponding to Application No. 201680053333.8; dated Dec. 12, 2018.

* cited by examiner

INK JET HEAD AND INK JET RECORDING APPARATUS

CROSS REFERENCE TO RELATED APPLICATIONS

This is the U.S. national stage of application No. PCT/JP2016/076734, filed on Sep. 12, 2016. Priority under 35 U.S.C. § 119(a) and 35 U.S.C. § 365(b) is claimed from Japanese Application No. 2015-184585, filed on Sep. 18, 2015, the disclosure of which is also incorporated herein by reference.

TECHNICAL FIELD

The present invention relates to an ink jet head and an ink jet recording apparatus.

BACKGROUND ART

There have been ink jet recording apparatuses that form an image on a recording medium by ejecting ink droplets from nozzles formed in an ink jet head.

In such an ink jet recording apparatus, nozzle clogging occurs due to air bubbles formed in the ink jet head or foreign matter or the like existing in the ink jet head, and a problem such as defective ejection is caused. Depending on the type of ink, the ink viscosity near the nozzles becomes higher due to ink particle sedimentation or the like, if the apparatus is left unused for a long time. As a result, it might become difficult to achieve stable ink ejection performance.

To counter this, there is a known ink jet recording apparatus that includes circulation flow paths that are provided in the head chip of the ink jet head and are capable of circulating ink, so that air bubbles and the like in the head can be made to flow, together with the ink, into the circulation flow paths.

For example, Patent Literature 1 discloses an ink jet head that includes: nozzles arranged in rows; a common supply flow path (a fluid inlet path) that supplies ink commonly to respective pressure chambers (pump chambers) that communicate with the respective nozzles; and a common circulation flow path (a recirculation channel) with which discrete circulation flow paths that discharge the ink near the respective nozzles communicate.

CITATION LIST

Patent Literature

Patent Literature 1: JP 5563332 B2

SUMMARY OF INVENTION

Technical Problem

Meanwhile, in these days, there is a demand for a reduction in the size of an ink jet head, and a demand for nozzles arranged at high density to achieve a higher image resolution. However, in a structure that includes a common supply flow path (a common supply liquid chamber) and a common circulation flow path in the head chip as disclosed in Patent Literature 1, a relatively large space is required in the head chip. Because of this, the head chip becomes larger in size, and it becomes difficult to arrange nozzles at high density. Furthermore, if the head chip becomes larger in size, the production costs become higher due to an increase in the amount of material to be used in the manufacturing.

It is also known that, when ink is ejected from nozzles, the pressure in the pressure chambers becomes slightly negative, and therefore, the ink is guided toward the pressure chambers from the ink flow paths on the upstream side and the downstream side of the pressure chambers. In a structure that has circulation flow paths in the head chip as disclosed in Patent Literature 1, ink is also guided into the pressure chambers from the circulation flow paths. In a case where the circulation flow paths are formed in the vicinities of nozzles, the pressure in the vicinities of the nozzles fluctuates, and therefore, the ink ejection stability becomes lower. Furthermore, the meniscuses of the nozzles might break.

The present invention has been made in view of those problems, and an object of the present invention is to provide an ink jet head and an ink jet recording apparatus that are small in size, are capable of achieving a higher resolution, have a high ejection stability, require low production costs, and include flow paths in which ink can be circulated.

Solution to Problem

To achieve the above object, the invention claimed in claim 1 is an ink jet head that includes:

a head chip including:

a plurality of nozzles that eject ink;

a plurality of pressure chambers that communicate with the respective nozzles, and store ink;

a plurality of pressure generating means that correspond to the respective pressure chambers, and apply pressure to the ink in the corresponding pressure chambers;

a plurality of discrete circulation flow paths that branch from ink flow paths extending from inlets of the pressure chambers to outlets of the nozzles, and are capable of discharging the ink in the pressure chambers; and a common circulation flow path with which at least two of the discrete circulation flow paths communicate; and a common supply liquid chamber that is provided on an upper surface of the head chip, and stores ink to be commonly supplied to the respective pressure chambers through a plurality of ink supply holes formed in the upper surface of the head chip.

The invention claimed in claim 2 is the ink jet head according to claim 1, wherein the discrete circulation flow paths branch from portions located between end portions of the pressure chambers on outlet sides and the outlets of the nozzles in the ink flow paths.

The invention claimed in claim 3 is the ink jet head according to claim 1 or 2, wherein the ink flow paths include communicating paths through which the nozzles communicate with the pressure chambers, and the discrete circulation flow paths branch from the communicating paths.

The invention claimed in claim 4 is the ink jet head according to any of claims 1 to 3, wherein the common circulation flow path and the pressure chambers are provided in positions that at least partially overlap in a direction of ink ejection from the nozzles.

The invention claimed in claim 5 is the ink jet head according to any of claims 1 to 4, wherein the nozzles are arranged in a plurality of rows, and the common circulation flow path is provided for every row or every other row of the rows of the nozzles.

The invention claimed in claim 6 is the ink jet head according to any of claims 1 to 5, further including a first damper that is provided to face at least one of the plurality of the discrete circulation flow paths and the common circulation flow path, and are capable of changing volumes of flow paths when being elastically deformed by pressure.

The invention claimed in claim 7 is the ink jet head according to any of claims 1 to 6, further including a first damper that is provided to face at least one of an upper portion and a lower portion of the common circulation flow path, and are capable of changing volumes of flow paths when being elastically deformed by pressure, wherein the first damper has an air chamber on the opposite side from the common circulation flow path, the air chamber facing the first damper.

The invention claimed in claim 8 is the ink jet head according to any of claims 1 to 7, further including a second damper that is provided to face the common supply liquid chamber, and are capable of changing a volume of the common supply liquid chamber when being elastically deformed by pressure.

The invention claimed in claim 9 is an ink jet recording apparatus that includes:

the ink jet head according to any of claims 1 to 8; and a circulating means that generates circulatory flows from the ink flow paths to the discrete circulation flow paths.

Advantageous Effects of Invention

According to the present invention, an ink jet head that has flow paths capable of circulating ink has a small size, can achieve a higher resolution, can increase its ejection stability, and can lower production costs.

DESCRIPTION OF EMBODIMENTS

Figure 1:
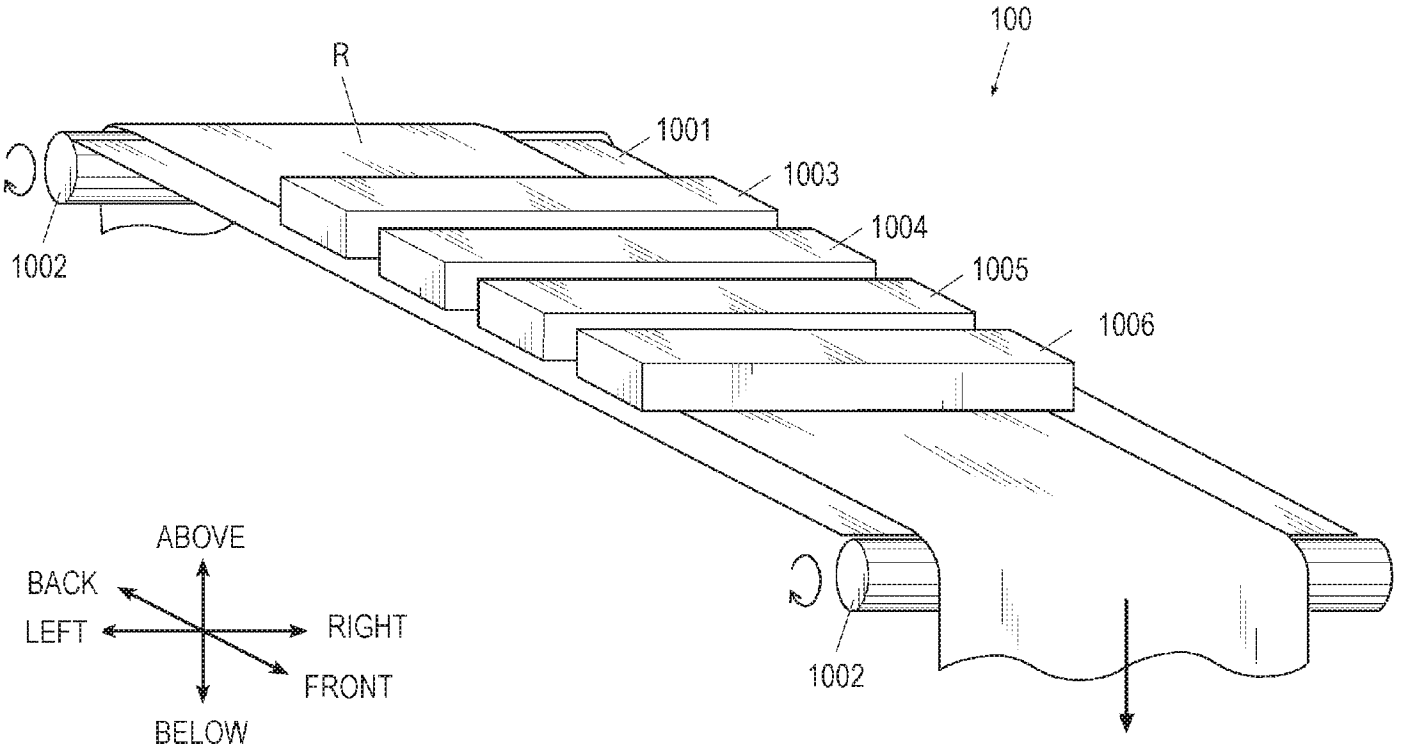
FIG. 1 is a perspective view schematically showing the structure of an ink jet recording apparatus.

The following is a description of preferred embodiments of the present invention, with reference to the drawings. However, the scope of the invention is not limited to the illustrated examples. In the description below, components having like functions and structures are denoted by like reference numerals, and explanation of them will not be repeated.

It should be noted, in the description below, an embodiment in which drawing is performed only through conveyance of a recording medium with line heads by a one-path drawing method will be described as an example. However, any appropriate drawing method may be adopted. For example, a drawing method using a scan technique or a drum technology may be adopted.

Also, in the description below, the direction of conveyance of a recording medium R is a front-back direction, a direction perpendicular to the direction of conveyance on the conveyance surface of the recording medium R is a transverse direction, and a direction perpendicular to the front-back direction and the transverse direction is a vertical direction.

[Outline of an Ink Jet Recording Apparatus]

Figure 6:
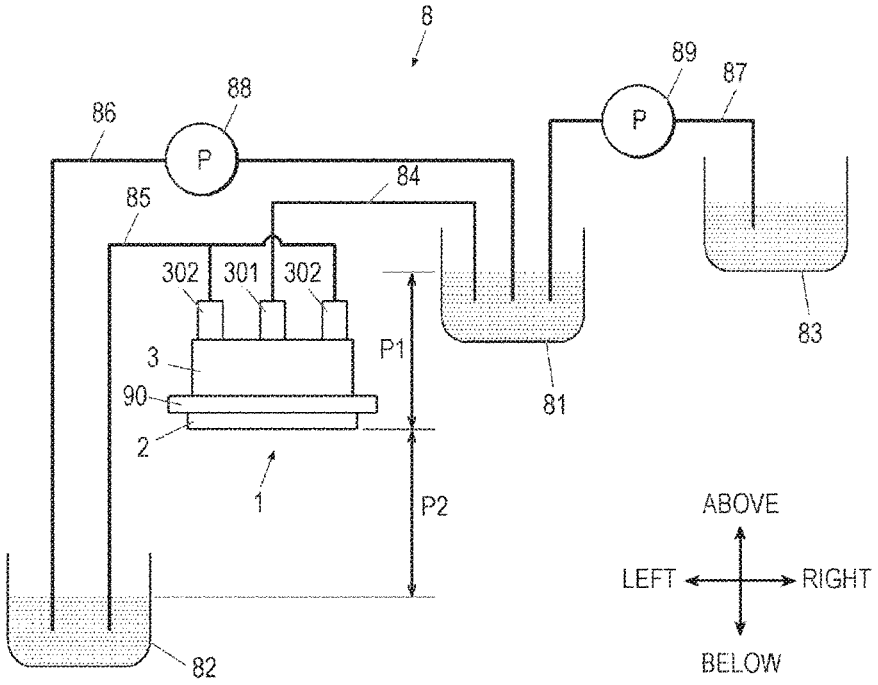
FIG. 6 is a schematic diagram for explaining the structure of an ink circulation mechanism.

An ink jet recording apparatus 100 includes a platen 1001, conveyance rollers 1002, line heads 1003, 1004, 1005, and 1006, an ink circulation mechanism 8, and the like (see FIG. 1 and FIG. 6).

The platen 1001 supports a recording medium R on its upper surface, and, when the conveyance rollers 1002 are driven, conveys the recording medium R in a conveyance direction (front-back direction).

From the upstream side to the downstream side in the direction of conveyance (front-back direction) of the recording medium R, the line heads 1003, 1004, 1005, and 1006 are arranged in parallel in the width direction (transverse direction) perpendicular to the conveyance direction. In the line heads 1003, 1004, 1005, and 1006, at least one ink jet head 1 that will be described later is provided, and ejects cyan (C), magenta (M), yellow (Y), and black (K) inks, for example, toward the recording medium R.

The ink circulation mechanism 8 will be described later (see FIG. 6).

[Outline of the Structure of an Ink Jet Head]

Referring now to FIG. 2 through FIG. 5, the outline of the structure of an ink jet head 1 is described.

Figure 3:
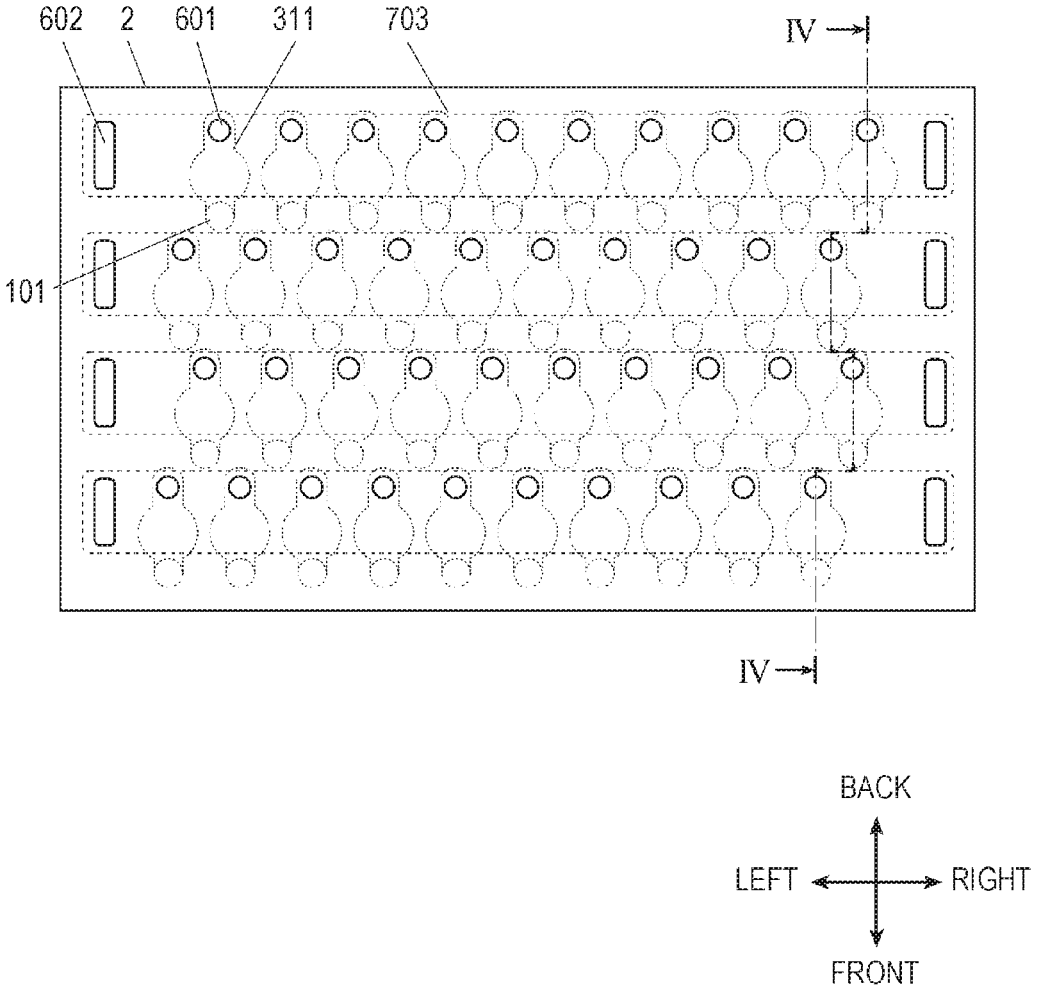
FIG. 3 is a plan view of a head chip.
Figure 4:
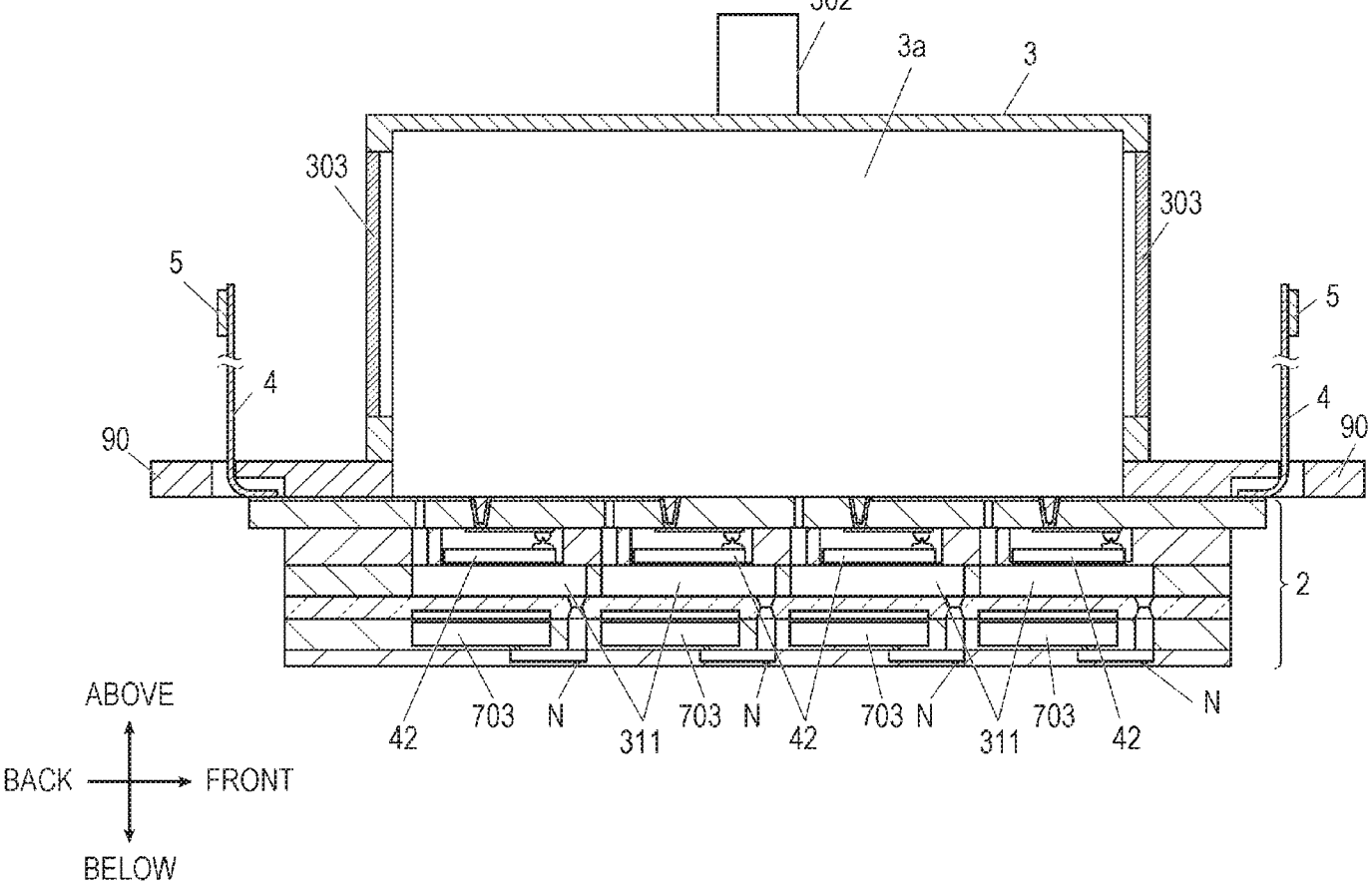
FIG. 4 is a cross-sectional view of the ink jet head, taken along the line IV-IV defined in FIG. 3.

FIG. 3 is a plan view of a head chip 2, and dashed lines indicate some of the components formed in the head chip 2.

The ink jet head 1 includes the head chip 2, a common ink chamber 3, connecting members 4, a holding unit 90, and the like (see FIG. 2 through FIG. 5).

Figure 2A:
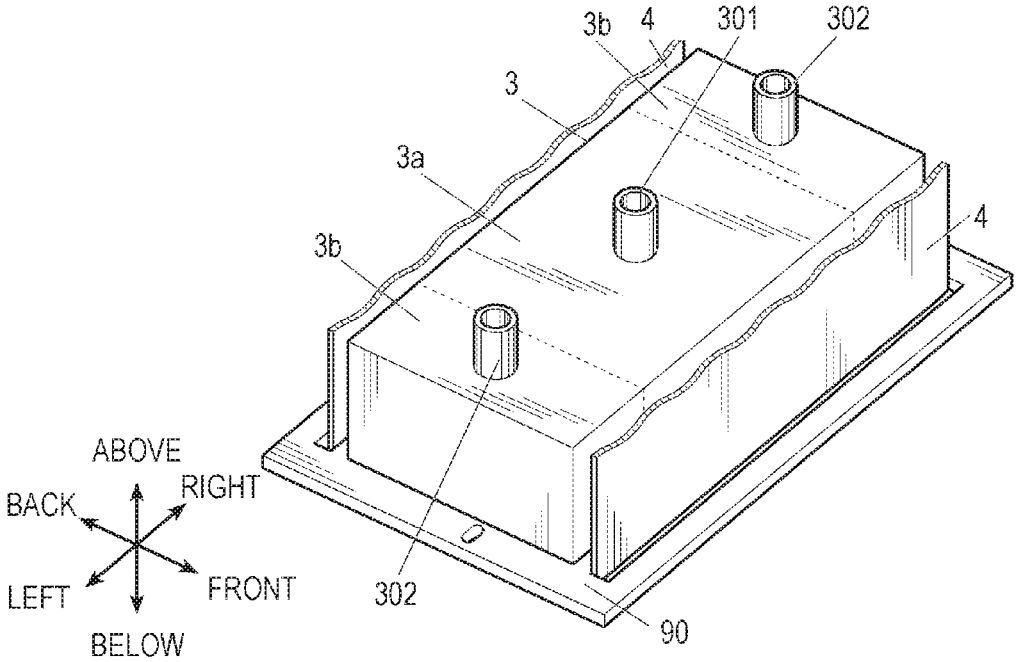
FIG. 2A is a perspective view of an ink jet head as viewed from above.
Figure 2B:
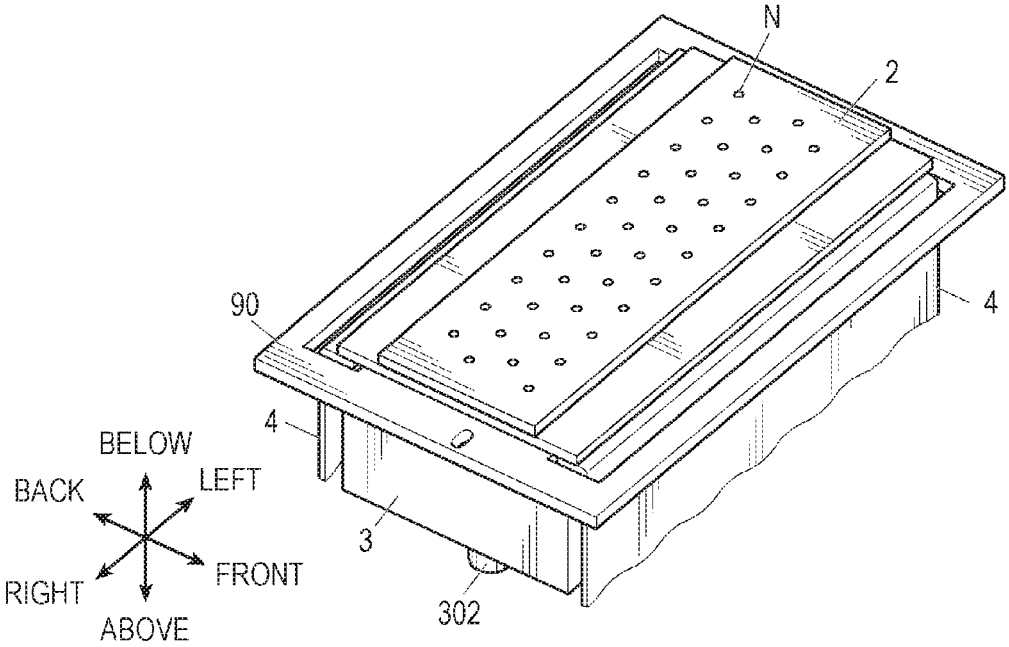
FIG. 2B is a perspective view of the ink jet head as viewed from below.

The head chip 2 formed with substrates stacked in an upward direction, and a large number of nozzles N that eject ink are provided in the lowermost substrate (see FIG. 2B). In the head chip 2, there are pressure chambers 311 that correspond to the respective nozzles N and store ink, and piezoelectric elements 42 as pressure generating means. A large number of ink supply holes 601 that correspond to the pressure chambers 311 are formed in the uppermost substrate of the head chip 2 (see FIG. 3, FIG. 5, and others), and ink is supplied from the common ink chamber 3 to the pressure chambers 311 through the ink supply holes 601. As the piezoelectric elements 42 are displaced, pressure is applied to the ink stored in the pressure chambers 311, and ink droplets are ejected from the nozzles N.

The common ink chamber 3 includes a common supply liquid chamber 3*a* and two common discharged liquid chambers 3*b* (see FIG. 2A and others), and each ink chamber is filled with one of cyan (C), magenta (M), yellow (Y), and black (K) inks, for example.

The common supply liquid chamber 3*a* is provided on the upper surface of the head chip 2 and at the central portion of the common ink chamber 3, and stores the ink to be supplied to the respective pressure chambers 311 through the ink supply holes 601 formed in the upper surface of the head chip 2. An ink supply port 301 is formed at an upper portion of the common supply liquid chamber 3*a*, and ink is supplied by the ink circulation mechanism 8 through the ink supply port 301. Further, second dampers 303 are formed at part of the external walls on the front and back sides of the common supply liquid chamber 3*a* (see FIG. 4). The second dampers 303 are formed with a resin such as elastic polyimide or a metallic material such as stainless steel, and prevents a rapid increase or decrease in the inner pressure in the common ink chamber 3.

The two common discharged liquid chambers 3*b* are provided at the right and left end portions of the common ink chamber 3, and store ink discharged from ink discharge holes 602 formed in the upper surface of the head chip 2. Ink discharge ports 302 are also formed at upper portions of the common discharged liquid chambers 3*b*, and the ink in the common discharged liquid chambers 3*b* is discharged by the ink circulation mechanism 8 to the outside of the ink jet head 1 through the ink discharge ports 302.

The connecting members 4 are wiring members connected to drive units 5 formed with FPCs, for example, and are connected to discrete wiring lines 57 on the upper surface of a wiring substrate 50 at the end portions on the front and back sides of the head chip 2. With this arrangement, electricity is supplied from the drive units 5 to the piezoelectric elements 42 through the connecting members 4 and the discrete wiring lines 57.

The holding unit 90 is joined to the upper surface of the head chip 2, and supports the common ink chamber 3. After the holding unit 90 is set and positioned on the upper surface of the head chip 2, the common ink chamber 3 can be set, with the holding unit 90 serving as a guide. Thus, the common ink chamber 3 can be formed with high precision on the upper surface of the head chip 2.

Further, to perform position adjustment with high precision, alignment marks (not shown) are preferably formed on the head chip 2 and the holding unit 90 prior to the joining.

[Head Chip]

Next, the head chip 2 is described in detail.

Figure 5:
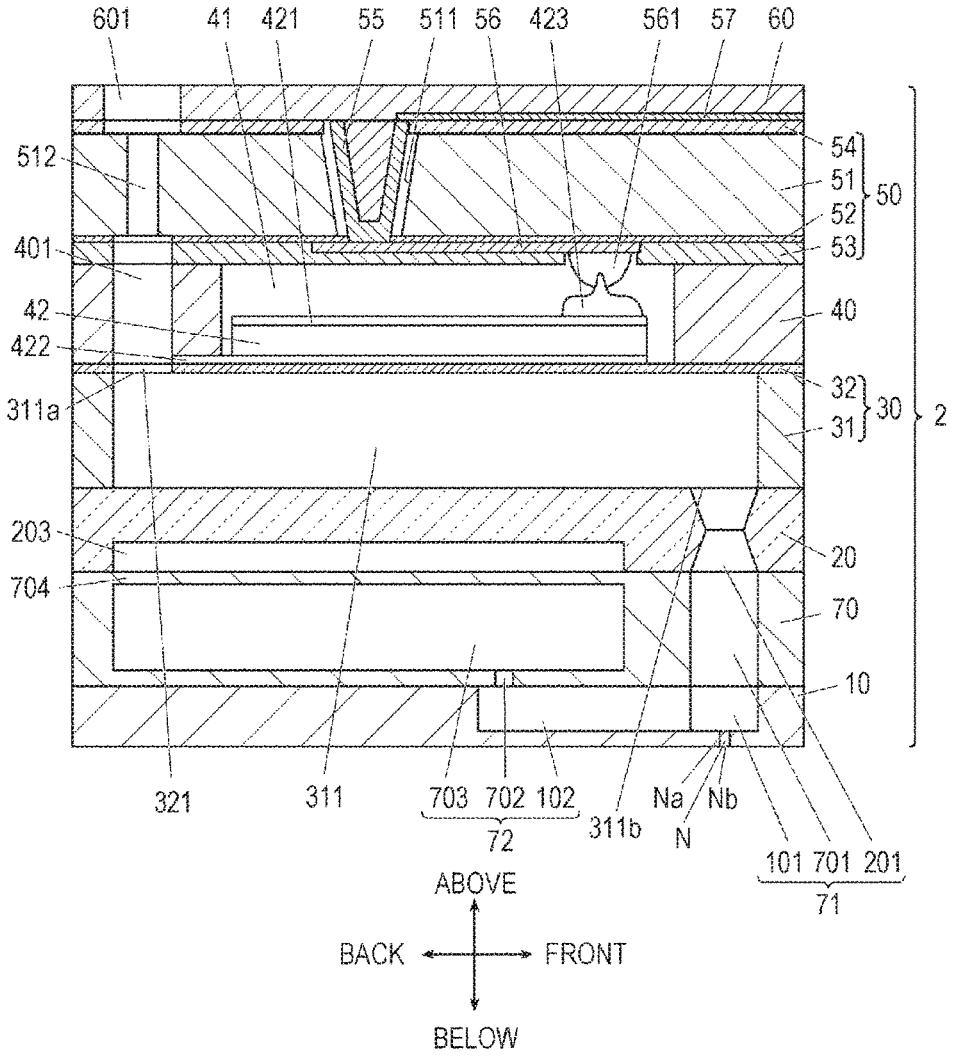
FIG. 5 is an enlarged view of a section of the inkjet head.

The head chip 2 is formed by stacking and integrating a nozzle substrate 10, a common flow path substrate 70, an intermediate substrate 20, a pressure chamber substrate 30, a spacer substrate 40, the wiring substrate 50, and an adhesion layer 60 in this order from the bottom (see FIG. 5).

In the nozzle substrate 10, the nozzles N, large-diameter portions 101 that communicate with the nozzles N and have a larger diameter than the nozzles N, and discrete circulation flow paths 102 that branch from the large-diameter portions 101 and are to be used for ink circulation. For example, the nozzles N are arranged in more than one row (four rows, for example) in the transverse direction, for example (see FIG. 2).

The nozzle substrate 10 is formed with a SOI substrate, and is processed with high precision by anisotropic etching. Accordingly, the length of the nozzles N in the vertical direction and the thickness of the lower portions of the discrete circulation flow paths 102 can be made as small as approximately 10 μm, for example. Further, the discrete circulation flow paths 102 branch from the large-diameter portions 101 located above the nozzles N. Thus, the ink in the vicinities of the nozzles N can be circulated, and air bubbles and the like in the vicinities of the nozzles N can be made to flow into the discrete circulation flow paths 102.

The common flow path substrate 70 is a substrate made of silicon, and large-diameter portions 701, narrowed portions 702, and common circulation flow paths 703 are formed in the common flow path substrate 70.

The large-diameter portions 701 penetrate the common flow path substrate 70 in the vertical direction. The large-diameter portions 701 have the same diameter as the large-diameter portions 101 of the nozzle substrate 10, and communicate with the respective large-diameter portions 101.

The discrete circulation flow paths 102 of one row of the nozzles N arranged in the array direction (transverse direction) communicate with a common circulation flow path 703 through a narrowed portion 702, and ink flowing from the discrete circulation flow paths 102 join in the common circulation flow path 703. The common circulation flow paths 703 are also formed in the array direction of the nozzles N (transverse direction), and have upward flow paths near the right end and the left end of the head chip 2. The upward flow paths communicate with the ink discharge holes 602 in the upper surface of the head chip 2 (see FIG. 3 and others). In the description below, the discrete circulation flow paths 102, the narrowed portions 702, and the common circulation flow paths 703 will be also collectively referred to as circulation flow paths 72. If the flow path impedance of the discrete circulation flow paths 102 can be made sufficiently high, the narrowed portions 702 can be omitted.

Further, a first damper 704 is formed in the common flow path substrate 70. The first damper 704 is made of elastically-deformable silicon, a metal, or a resin, for example, and the common flow path substrate 70 may be formed by stacking layers with an adhesive.

The first damper 704 is formed with a Si substrate of 1 to 50 μm in thickness, for example. The first damper 704 is designed to face the upper surfaces of the common circulation flow paths 703, and air chambers 203 are formed on the upper surface of the first damper 704. Being a thin Si substrate, the first damper 704 is elastically deformed due to a pressure difference between the common circulation flow paths 703 and the air chambers 203 so that the volume of each common circulation flow path 703 can be changed. For example, pressure is applied to the pressure chambers 311 at once, to cause ink ejection. The ink flows into the common circulation flow paths 703 at once, and rapidly decreases the pressure in the common circulation flow paths 703. In such a case, the first damper 704 is elastically deformed downward, to prevent a rapid pressure fluctuation in the ink flow paths. Further, the air chambers 203 are designed as closed spaces. With this, the damping force generated when the first damper 704 vibrates while being deformed can act to further prevent a pressure fluctuation.

Although the discrete circulation flow paths 102 of one row of the nozzles N arranged in the array direction (transverse direction) communicate with a common circulation flow path 703 in this example, the discrete circulation flow paths 102 of two rows may communicate with a common circulation flow path 703.

The intermediate substrate 20 is a substrate made of glass. Communicating holes 201 that penetrate the intermediate substrate 20 in the vertical direction, and space portions that are recesses in the upward direction and form the air chambers 203 on the upper surface of the first damper 704 are formed in the intermediate substrate 20.

The communicating holes 201 communicate with the large-diameter portions 701. Further, the communicating holes 201 each have such a shape as to narrow an ink pathway, and are designed to adjust the kinetic energy to be applied to the ink when the ink is ejected. In the description below, the communicating holes 201, the large-diameter portions 701, and the large-diameter portions 101 will be also collectively referred to as communicating paths 71.

The pressure chamber substrate 30 is formed with a pressure chamber layer 31 and a vibrating plate 32.

The pressure chamber layer 31 is a substrate made of silicon, and the pressure chambers 311 in which ink ejected from the nozzles N is stored are formed in the pressure chamber layer 31. The pressure chambers 311 are also arranged in rows (four rows, for example) corresponding to the nozzle rows in the transverse direction (see FIG. 3). Further, at front lower portions (outlets 311*b* of the pressure chambers), the pressure chambers 311 communicate with the communicating paths 71 that serve as the flow paths when ink is ejected. The pressure chambers 311 are also designed to extend in the front-back direction while penetrating the pressure chamber layer 31 in the vertical direction.

The vibrating plate 32 is stacked on the upper surface of the pressure chamber layer 31 to cover the openings of the pressure chambers 311, and thus forms the upper wall portions of the pressure chambers 311. An oxide film is formed on the surface of the vibrating plate 32. Further, through holes 321 that communicate with the pressure chambers 311 and penetrate the vibrating plate 32 in the upward direction are formed in the vibrating plate 32.

The spacer substrate 40 is a substrate made of 42-alloy, and is a partition layer that forms spaces 41 for housing the piezoelectric elements 42 and the like between the vibrating plate 32 and the wiring substrate 50.

The piezoelectric elements 42 are formed to have substantially the same planar shape as the pressure chambers 311, and are positioned to face the pressure chambers 311 via the vibrating plate 32. The piezoelectric elements 42 are actuators formed with PZT (piezoelectric zirconate titanate) for deforming the vibrating plate 32. Two electrodes 421 and 422 are further formed on the upper surface and the lower surface of each piezoelectric element 42, and the electrode 422 on the lower surface side is connected to the vibrating plate 32.

Further, through holes 401 that communicate with the through holes 321 of the vibrating plate 32 and penetrate the spacer substrate 40 in the upward direction are formed in the spacer substrate 40 independently of the spaces 41.

The wiring substrate 50 includes an interposer 51 that is a substrate made of silicon. The lower surface of the interposer 51 is coated with two insulating layers 52 and 53 made of silicon oxide, and the upper surface is coated with an insulating layer 54 also made of silicon oxide. Of the insulating layers 52 and 53, the insulating layer 53 located on the lower side is stacked on the upper surface of the spacer substrate 40.

Through holes 511 that penetrate the interposer 51 in the upward direction are formed in the interposer 51, and through electrodes 55 are inserted in the through holes 511. One end of a wiring line 56 extending in a horizontal direction is connected to the lower end of each through electrode 55, and a stud bump 423 provided on the electrode 421 on the upper surface of the corresponding piezoelectric element 42 is connected to the other end of the wiring line 56 via a solder 561 exposed to the inside of the space 41. A discrete wiring line 57 is connected to the upper end of each through electrode 55, and the discrete wiring line 57 further extends in a horizontal direction to connect to a connecting member 4 (see FIG. 4).

Further, inlets 512 that communicate with the through holes 401 of the spacer substrate 40 and penetrate the interposer 51 in the upward direction are formed in the interposer 51. It should be noted that, of the insulating layers 52 through 54, the respective portions that coat the portions in the vicinities of the inlets 512 are designed to have a larger opening size than the inlets 512.

The adhesion layer 60 is a photosensitive resin layer that adheres to the holding unit 90, and is also a protection layer that protects the discrete wiring lines 57. The adhesion layer 60 is stacked on the upper surface of the insulating layer 54 of the interposer 51 while covering the discrete wiring lines 57 provided on the upper surface of the wiring substrate 50. Further, the ink supply holes 601 that communicate with the inlets 512 and penetrate the adhesion layer 60 in the upward direction are formed in the adhesion layer 60.

Next, ink circulation paths in the head chip 2 are described. Ink is supplied from the common supply liquid chamber 3*a* of the common ink chamber 3 to the inside of the head chip 2 through the ink supply holes 601 corresponding to the respective nozzles N. The ink then flows into the inlets 512, the through holes 401, and the pressure chambers 311 in this order. The ink then flows into the communicating paths 71 (the communicating holes 201, the large-diameter portions 701, and the large-diameter portions 101 in this order) that serve as the ink flow paths when the ink is ejected. The ink then flows into the discrete circulation flow paths 102 branching from the large-diameter portions 101, and the ink flowing out of the discrete circulation flow paths 102 join in the common circulation flow paths 703. In the common circulation flow paths 703, the ink flows toward the left or right end of the head chip 2, and lastly, is discharged into the common discharged liquid chambers 3*b* of the common ink chamber 3 through the ink discharge holes 602 formed in the upper surface of the head chip (see FIG. 3 and others).

In the above described example, the discrete circulation flow paths 102 branch from the communicating paths 71 through which the nozzles N communicate with the pressure chambers 311. However, the discrete circulation flow paths 102 may branch from the ink flow paths that extend from the inlets 311*a* of the pressure chambers 311 to the outlets Nb of the nozzles N. Here, each discrete circulation flow path 102 preferably branches from a portion located between the end of the pressure chamber 311 on side of the outlet 311*b* and the outlet Nb of the nozzle N in the corresponding ink flow path.

The inlet 311*a* (an ink inlet) and the outlet 311*b* (the ink outlet communicating with the inlet Na of the corresponding nozzle N) of a pressure chamber 311, and the inlet Na (an ink inlet) and the outlet Nb (an ink outlet) of the nozzle N are shown in FIG. 5.

Also, in a case where the circulation flow paths 72 branch from the nozzles N, and a substrate in which the nozzles N are formed as through holes is the nozzle formation substrate, the circulation flow paths 72 are preferably formed in the following manner: grooves that correspond to the respective nozzles N and are to form the circulation flow paths 72 are formed in the surface of the nozzle formation substrate on the side of the pressure chambers 311, and the nozzle formation substrate is joined to the flow path substrate in which the flow paths communicating with the nozzles N are formed.

Here, the common circulation flow paths 703 and the narrowed portions may be formed in the nozzle formation substrate, or may be formed in the flow path substrate.

In a case where the common circulation flow paths 703 and the narrowed portions are formed in the flow path substrate, for example, the circulation flow paths 72 are preferably formed in the following manner: narrowed portions that correspond to the respective nozzles N and are adjacent to one side or grooves (the discrete circulation flow paths 102) that reach the common circulation flow paths 703 are formed in the nozzle formation substrate, and the nozzle formation substrate is joined to the flow path substrate in which the narrowed portions or the common circulation flow paths 703 are formed.

For example, in the embodiment shown in FIG. 5, the nozzles N as through holes are formed in the nozzle substrate 10, so that the nozzle formation substrate is formed. Grooves that communicate with the respective nozzles N, reach the narrowed portions 702 adjacent to the other side, and are to from the discrete circulation flow paths 102 are formed in the surface of the nozzle formation substrate on the side of the common flow path substrate 70, and the nozzle formation substrate is joined to the common flow path substrate 70 (the flow path substrate). In this manner, the discrete circulation flow paths 102, the narrowed portions 702, and the common circulation flow paths 703, which branch from the nozzles N, can be formed.

In a case where the circulation flow paths 72 branch from the nozzles N, the hole diameter of each nozzle N preferably becomes gradually smaller in a tapered fashion in the direction from the inlet Na of the nozzle N.

In a case where the circulation flow paths 72 branch from the end portions of the pressure chambers 311 on the side of the outlets 311*b*, the circulation flow paths 72 are preferably formed in the following manner: grooves that correspond to the respective pressure chambers 311 and are to form the circulation flow paths 72 are formed in the surface of the pressure chamber substrate 30 on which the pressure chambers 311 are formed on the side of the nozzles N, and the pressure chamber substrate is joined to the flow path substrate in which the flow paths communicating with the pressure chambers 311 are formed.

The common circulation flow paths 703 and the narrowed portions may be formed in the pressure chamber substrate 30, or may be formed in the flow path substrate.

In a case where the common circulation flow paths 703 and the narrowed portions are formed in the flow path substrate, the circulation flow paths 72 are preferably formed in the following manner: narrowed portions that correspond to the respective pressure chambers 311 and are adjacent to one side and grooves (the discrete circulation flow paths 102) that reach the common circulation flow paths 703 are formed in the pressure chamber substrate 30, and the pressure chamber substrate 30 is joined to the flow path substrate in which the narrowed portions and the common circulation flow paths 703 are formed.

For example, in the embodiment shown in FIG. 5, the discrete circulation flow paths 102 in the nozzle substrate 10 are eliminated, and the intermediate substrate 20 is formed with a Si substrate. The common circulation flow paths 703, the narrowed portions 702, and the first damper 704 are formed, with the positions of the narrowed portions 702 and the position of the first damper 704 being interchanged in the vertical direction. That is, the narrowed portions 702 are formed above the first damper 704 and at the back-side end portions of the common circulation flow paths 703. The air chambers 203 are then formed above the common flow path substrate 70.

Also, the positions of the common circulation flow paths 703, the narrowed portions 702, and the first damper 704 are shifted backward in FIG. 5, so that the narrowed portions 702 are arranged in positions shifted backward in FIG. 5 and do not overlap the pressure chambers 311 when viewed from above and below in FIG. 5. Grooves that communicate with the respective pressure chambers 311 are formed in the surface on the intermediate-substrate-20 side of the pressure chamber substrate 30 forming the pressure chambers 311, and the grooves reach the narrowed portions 702 adjacent to the other side and are to form the discrete circulation flow paths 102. The pressure chamber substrate 30 is joined to the intermediate substrate 20 (the flow path substrate). In this manner, the discrete circulation flow paths 102, the narrowed portions 702, and the common circulation flow paths 703 can be formed. In a case where the narrowed portions 702 are not prepared, the narrowed portions 702 may be turned into the common circulation flow paths 703.

[Ink Circulation Mechanism]

The ink circulation mechanism 8 as an ink circulating means is formed with a supply sub tank 81, a circulation sub tank 82, a main tank 83, and the like (FIG. 6).

The supply sub tank 81 is filled with the ink to be supplied to the common supply liquid chamber 3*a* of the common ink chamber 3, and is connected to the ink supply port 301 by an ink flow path 84.

The circulation sub tank 82 is filled with the ink discharged from the common discharged liquid chambers 3*b* of the common ink chamber 3, and is connected to the ink discharge ports 302 and 302 by an ink flow path 85.

The supply sub tank 81 and the circulation sub tank 82 are provided in different positions in the vertical direction (gravity direction) with respect to the nozzle surface of the head chip 2 (the nozzle surface will be hereinafter also referred to as the "positional reference surface"). Therefore, a pressure P1 is generated due to a water head difference between the positional reference surface and the supply sub tank 81, and a pressure P2 is generated due to a water head difference between the positional reference surface and the circulation sub tank 82.

Further, the supply sub tank 81 and the circulation sub tank 82 are connected by an ink flow path 86. By a pressure applied by a pump 88, the ink can be returned from the circulation sub tank 82 to the supply sub tank 81.

The main tank 83 is filled with the ink to be supplied to the supply sub tank 81, and is connected to the supply sub tank 81 by an ink flow path 87. By a pressure applied by a pump 89, the ink can be supplied from the main tank 83 to the supply sub tank 81.

It is possible to adjust the pressure P1 and the pressure P2 by adjusting the amount of ink in each of the above described sub tanks, and further changing the position of each sub tank in the vertical direction (gravity direction). By a pressure difference between the pressure P1 and the pressure P2, the ink in upper portions of the nozzles N can be circulated at an appropriate circulation flow velocity. With this, air bubbles formed in the head chip 2 can be removed, and clogging of the nozzles N, defective ejection, and the like can be prevented.

[Ejection Stability Evaluation]

The common supply liquid chamber 3*a* of the present invention is provided on the upper surface of the head chip 2, and stores the ink to be supplied to the respective pressure chambers 311 through the ink supply holes 601 formed in the upper surface of the head chip 2. As the common supply liquid chamber 3*a* that requires a relatively large volume is provided on the upper surface of the head chip 2 as described above, the space for housing the common supply liquid chamber 3*a* can be easily secured even in a small-sized ink jet head 1. As the volume of the common supply liquid chamber 3*a* is increased, the viscosity resistance R and the inertance L of the common supply liquid chamber 3*a* can be reduced. As a result, most of the ink supply to the pressure chambers 311 can be made from the side of the common supply liquid chamber 3*a* (the upstream side) when the pressure chambers 311 have negative pressures.

In this manner, ink can be easily supplied from the side of the common supply liquid chamber 3*a* to the pressure chambers 311. Accordingly, ink is not easily guided to the communicating paths 71 from the circulation flow paths 72, and pressure fluctuations in the vicinities of the nozzles N are reduced. Thus, ink ejection stability can be increased.

Next, the results of evaluation of the ink ejection stability in the ink jet head 1 of the present invention with the use of an equivalent circuit model are described.

Figure 7:
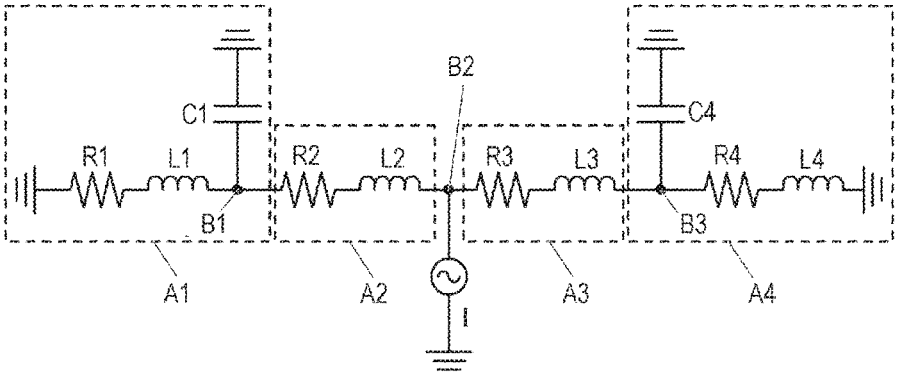
FIG. 7 is a circuit diagram of an equivalent circuit model in an ink flow path.

Specifically, a flow path was divided into the four flow paths: "(A1) the common supply liquid chamber 3*a*", "(A2) the ink flow path from the ink supply hole 601 to the large-diameter portion 101", "(A3) the discrete circulation flow path 102 and the narrowed portion 702", and "(A4) the common circulation flow path 703". For the respective flow paths A1 through A4, viscosity resistances R (R1 through R4), inertances L (L1 through L4), compliances C (C1 and C4) were calculated, and a current source I equivalent to the flow rate of the ink ejection from the nozzle N was supplied. Evaluation was made with the use of the equivalent circuit model (see FIG. 7). It should be noted that, in this model, the ink flow rate is equivalent to the current, and the pressure in the flow path is equivalent to the voltage. Also, the nozzle N is assumed to be located on a boundary between the large-diameter portion 101 of A2 and the discrete circulation flow path 102 of A3.

The methods of calculating the viscosity resistances R (R1 through R4), the inertances L (L1 through L4) of the flow paths, and the compliances C (C1 and C4) of the flow paths in the equivalent circuit model are now described.

In a case where the flow path has a rectangular parallelepiped shape, the inertance can be expressed as $L=\rho l/hw$, and the viscosity resistance can be expressed as $R=8\eta l(h+w)^2/(hw)^3$, where w (m) represents the width of the flow path (the front-back direction), h (m) represents the height of the flow path (the vertical direction), l (m) represents the length of the flow path (the transverse direction), $\eta$ (Pa·s) represents the fluid viscosity of the ink, and $\rho$ (kg/m$^3$) represents the ink density.

In a case where the flow path has a circular cylindrical shape, the inertance can be expressed as $L=4\rho l/\pi d^2$, and the viscosity resistance can be expressed as $R=128\ \eta l/\pi d^4$, where d (m) represents the diameter of the flow path, l (m) represents the height of the flow path (the vertical direction), $\eta$ (Pa·s) represents the fluid viscosity of the ink, and $\rho$ (kg/m$^3$) represents the ink density.

In the case of some other shape, such as a tapered shape, the calculations can be performed by minutely dividing the tapered shape in the longitudinal direction and integrating as a rectangular parallelepiped.

It should be noted that, in calculating the viscosity resistances R and the inertances L in the flow paths A2 and A3, these flow paths were regarded as being connected in series, and the sums of the numerical values in the respective flow paths were calculated.

As for the compliances C, C1 corresponds to the second dampers 303, and C4 corresponds to the first damper 704. Each compliance C is the reciprocal of a spring constant. Each compliance C is calculated by the finite element method, and "pL/MPa" can be converted into "nF".

Table 1 shows the values of the inertances L, the viscosity resistances R, and the compliances C in an example of the ink jet head 1 of the present invention designed by the above calculation methods. It should be noted that the respective numerical values of the flow paths A2 and A3 are obtained by dividing the corresponding values of the ink flow path corresponding to each nozzle N by the number (1024) of the nozzles N provided in the head chip 2. The inertance L and the viscosity resistance R of the ink path A4 are calculated by dividing the corresponding values of the common circulation flow paths 703 by the number of the common circulation flow paths 703, and the compliance C of the ink path A4 is calculated by multiplying the compliance of the common circulation flow paths 703 by the number of the common circulation flow paths 703.

TABLE 1

| | Inertance | | Viscosity resistance | | Compliance | |
|---|---|---|---|---|---|---|
| Flow path number | Number | Set value [μH] | Number | Set value [Ω] | Number | Set value [nF] |
| A1 | L1 | 0.013 | R1 | 0.0006 | C1 | $3.43200 \times 10^7$ |
| A2 | L2 | 0.191 | R2 | 0.1030 | — | — |
| A3 | L3 | 0.243 | R3 | 0.0268 | — | — |
| A4 | L4 | 15.47 | R4 | 0.0507 | C4 | $6.97392 \times 10^{10}$ |

In the ink jet head 1 of the present invention, inertances L and viscosity resistances R can be made smaller with the set values shown in Table 1. Here, the inertances L and the viscosity resistances R of the common supply liquid chamber 3*a* (A1) and the common circulation flow path 703 (A4) were calculated on the assumption that the flow path had a rectangular parallelepiped shape as described above. The width (w) of the flow path and the height (h) of the flow path in the common supply liquid chamber 3*a* can be made much greater than those in the common circulation flow path 703. Accordingly, the inertance L1 and the viscosity resistance R1 can be set at much smaller values than the inertance L4 and the viscosity resistance R4, respectively.

Figure 8:
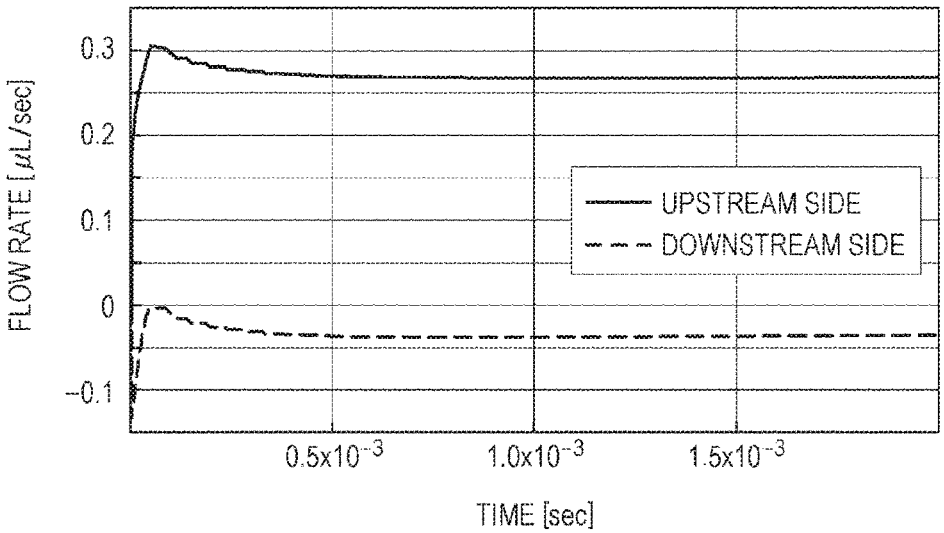
FIG. 8 is a graph showing the results of a simulation of the amount of ink flowing at point B2 when a predetermined amount of ink is ejected from nozzles.

FIG. 8 shows the results of a simulation performed to check the flow rates of the ink passing through a point (point B2) above a nozzle N after the ink was ejected from the nozzle N in a case where the amount of droplet ejection was 6 pL, the drive frequency was 50 kHz, and the number of nozzles was 1024 in the ink jet head 1 designed as shown in Table 1.

It should be noted that, in FIG. 8, the side of the common supply liquid chamber 3*a* (the A1 and A2 side) with respect to the point B2 is the upstream side, and the side of the circulation flow path 72 (the A3 and A4 side) with respect to the point B2 is the downstream side. The flow rate of the ink flowing from the upstream side toward the point above the nozzle N has a positive value, and the flow rate of the ink flowing from the downstream side toward the point above the nozzle N has a negative value.

As can be seen from FIG. 8, immediately after the start of ink ejection, most of the ink was supplied from the upstream side (A1 and A2) of the nozzle N. This is because the inertance (the sum of L1 and L2) on the upstream side of the nozzle N was much smaller than the inertance (the sum of L3 and L4) on the downstream side of the nozzle N, and accordingly, it was easy for the ink on the upstream side of the nozzle N to move instantly.

Also, as can be seen from FIG. 8, the flow rates remained almost constant after approximately $0.5\times10^{-3}$ seconds since the start of the ink ejection. This is because the influence of the inertance L serving as the index for the ink to move instantly became smaller over time, and the supply rate became gradually proportional to the viscosity resistance R of the flow path.

Figure 9:
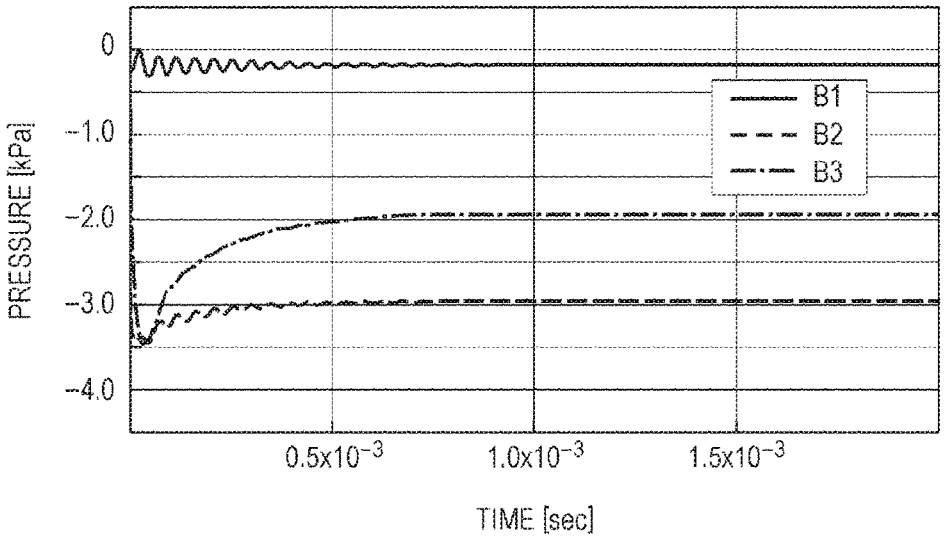
FIG. 9 is a graph showing the results of a simulation of pressure fluctuations at point B1, point B2, and point B3 in a flow path when a predetermined amount of ink is ejected from nozzles.

Next, when ink ejection was performed as above, a simulation was conducted to check pressure fluctuations at a point (point B1) between A1 and A2, a point (point B2) between A2 and A3, and a point (point B3) between A3 and A4 in the flow path. The results of the simulation are now described (FIG. 9). Pressure fluctuations in the flow path can be calculated on the assumption that the amount of the ink ejected from the nozzle N is the current, and the pressure in the flow path is the voltage in the above described equivalent circuit model.

Here, the pressure fluctuation at the point B2 indicates the pressure fluctuation at a point above the nozzle N. If the pressure fluctuation at the point B2 is small, the ink ejection stability is high. As can be seen from the simulation results shown in FIG. 9, the pressure at the point B2 fluctuated in the range of −3.5 to −3.0 kPa, and the pressure fluctuation was approximately 0.5 kPa.

The ink ejection conditions in the simulation were that the amount of ejection of droplets was 6 pL, the drive frequency was 50 kHz, and the number of nozzles was 1024, and therefore, the flow rate of the ejected ink was very high. However, the pressure fluctuations were restricted to as low as approximately 0.5 kPa. A pressure fluctuation of 0.5 kPa is equivalent to an ink sub tank head value of 5 cm, and hardly affects the ejection velocity. As confirmed by the above facts, the ink jet head 1 of the present invention has a very high ink ejection stability.

Figure 10:
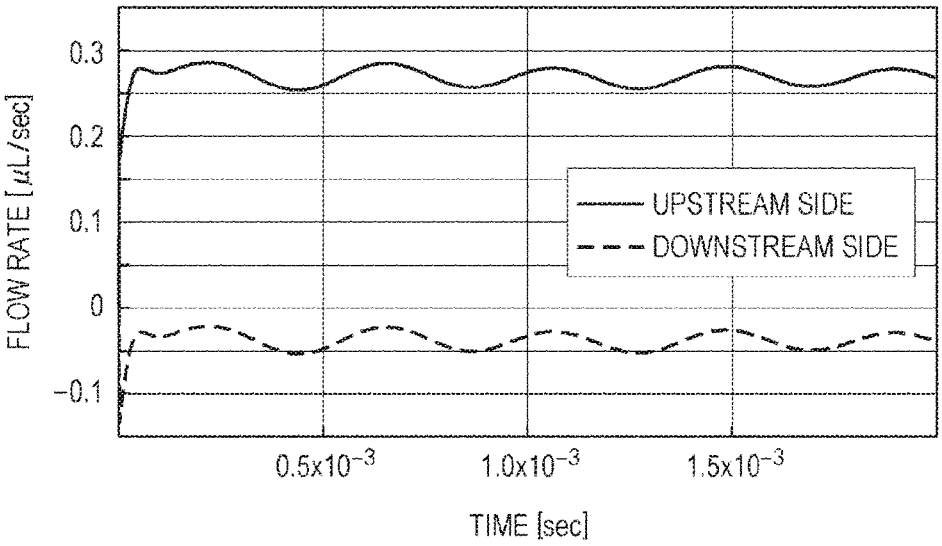
FIG. 10 is a graph showing the results of a simulation of the amount of ink flowing at point B2 when a predetermined amount of ink is ejected from nozzles in a comparative example (inertance L1 is 100 times higher).
Figure 11:
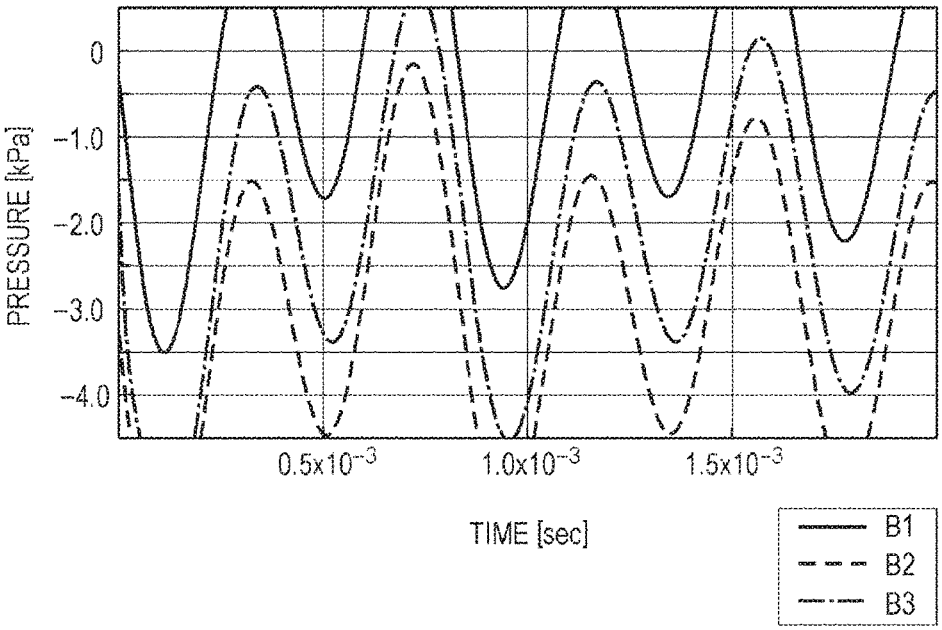
FIG. 11 is a graph showing the results of a simulation of pressure fluctuations at point B1, point B2, and point B3 in a flow path when a predetermined amount of ink is ejected from nozzles in a comparative example (inertance L1 is 100 times higher).

For reference, FIG. 10 shows the results of a simulation corresponding to the simulation shown in FIG. 8, and FIG. 11 shows the results of a simulation corresponding to the simulation shown in FIG. 9. These simulations were conducted as comparative examples in which the inertance L1 was 100 times higher than that of the set values shown in Table 1.

As shown in FIG. 10, in the case where the inertance L1 was 100 times higher, the ink supply from the upstream side was smaller, and the amount of ink supplied from the upstream side further decreased. On the other hand, the ink supply from the downstream side increased.

As shown in FIG. 11, the pressure fluctuation at the point B2 was as large as 4 kPa or more. As can be seen from the above examples, when the inertance L1 is made larger, pressure fluctuations become larger, and ejection stability becomes lower.

Technical Advantages of the Present Invention

As described so far, the ink jet head 1 of the present invention includes: the head chip 2 that includes: the discrete circulation flow paths 102 that branch from ink flow paths from the inlets 311*a* of the pressure chambers 311 to the outlets Nb of the nozzles N, and are capable of discharging the ink in the pressure chambers 311; and a common circulation flow path 703 with which at least two of the discrete circulation flow paths 102 communicate; and the common supply liquid chamber 3*a* that is provided on the upper surface of the head chip 2, and stores the ink to be supplied to the respective pressure chambers 311 through the ink supply holes 601 formed in the upper surface of the head chip 2.

Even in a small-sized ink jet head 1 having this structure, the volume for accommodating the common supply liquid chamber 3*a* can be easily secured, and the viscosity resistance R and the inertance L of the common supply liquid chamber 3*a* can be reduced. As a result, most of the ink can be supplied from the common supply liquid chamber 3*a* when the pressure chambers 311 have negative pressures due to ejection of the ink from the nozzles N. The ink is not easily guided toward the pressure chambers 311 from the circulation flow paths 72, and pressure fluctuations in the vicinities of the nozzles N are reduced. Thus, ink ejection stability can be increased. Further, the ink jet head 1 of the present invention can be made smaller in size. Thus, a higher resolution can be achieved with a small-sized ink jet head, and production costs can be lowered.

Also, in the ink jet head 1 of the present invention, the discrete circulation flow paths 102 branch from portions located between the end portions of the pressure chambers 311 on the side of the outlets 311*b* and the outlets Nb of the nozzles N, so that the ink in the vicinities of the nozzles N can be circulated.

The ink jet head 1 of the present invention further includes the communicating paths 71 through which the nozzles N communicate with the pressure chambers 311, and the discrete circulation flow paths 102 branch from the communicating paths 71, so that the ink in the vicinities of the nozzles N can be circulated.

Further, in the ink jet head 1 of the present invention, the common circulation flow paths 703 and the pressure chambers 311 are provided in positions that at least partially overlap in the direction of ink ejection from the nozzles N. With this arrangement, the ink jet head 1 can be made even smaller in size.

Also, in the ink jet head 1 of the present invention, the nozzles N are arranged in rows, and a common circulation flow path 703 is provided for every row or every other row of the rows of the nozzles. With this arrangement, the head chip 2 can be made smaller in size.

The ink jet head 1 of the present invention further includes the first damper 704 that is provided to face the discrete circulation flow paths 102 and/or the common circulation flow paths 703. With this arrangement, pressure fluctuations in the ink flow paths can be reduced.

The ink jet head 1 of the present invention further includes the first damper 704 that is provided to face upper portions and/or lower portions of the common circulation flow paths 703, and the first damper 704 has the air chambers 203 on the opposite side from the common circulation flow paths, the air chambers 203 facing the first damper 704. As the air chambers 203 are included in the structure, the first damper 704 can also be formed in the head chip 2.

The ink jet head 1 of the present invention also includes the second dampers 303 that are provided to face the common supply liquid chamber 3*a*. With this arrangement, pressure fluctuations in the ink flow paths can be reduced.

Other Aspects

The embodiments of the present invention disclosed in this specification are merely examples in all aspects, and should be construed as non-restrictive ones. The scope of the present invention is not limited to the above specific description but is shown by the claims, and it should be understood that equivalents of the claimed inventions and all modifications thereof are incorporated herein.

For example, the structures of the first damper 704 and the second dampers 303 can be modified as appropriate, if the first damper 704 and the second dampers 303 can be elastically deformed. For example, the first damper 704 and the second dampers 303 may be formed with stainless steel plates having an appropriate thickness.

Furthermore, the first damper 704 is positioned to face the circulation flow paths 72, but the size of the first damper 704 and the surface on which the first damper 704 is provided can be changed as appropriate. To achieve a high manufacturing efficiency, the first damper 704 is preferably formed on the upper surfaces or the lower surfaces of the circulation flow paths 72. However, the first damper 704 may be provided on the left surfaces or the right surfaces of the circulation flow paths 72.

Also, in the above description, the ink circulation mechanism 8 controls ink circulation with a water head difference. However, the ink circulation mechanism 8 may be modified as appropriate, as long as circulation flows can be generated as in the present invention.

Further, the ink jet head 1 ejects droplets such as ink droplets, using piezoelectric elements. However, the ink jet head 1 includes a mechanism that can eject droplets, and the mechanism may use thermal elements (electric thermal conversion elements), for example.

INDUSTRIAL APPLICABILITY

The present invention can be used in ink jet heads and ink jet recording apparatuses.

REFERENCE SIGNS LIST

1 Ink jet head
102 Discrete circulation flow path
203 Air chamber
3*a* Common supply liquid chamber
303 Second damper
311 Pressure chamber
311*a* Pressure chamber inlet
311*b* Pressure chamber outlet
42 Piezoelectric element (pressure generating means)
601 Ink supply hole
703 Common circulation flow path
704 First damper
71 Communicating path
8 Ink circulation mechanism (ink circulating means)
100 Ink jet recording apparatus
N Nozzle
Nb Nozzle outlet

The invention claimed is:

1. An ink jet head comprising:

a head chip including:

a plurality of nozzles that eject ink;

a plurality of pressure chambers that communicate with the respective nozzles, and store ink;

a plurality of pressure generating means that correspond to the respective pressure chambers, and apply pressure to the ink in the corresponding pressure chambers;

a plurality of discrete circulation flow paths that branch from ink flow paths extending from inlets of the pressure chambers to outlets of the nozzles, and are capable of discharging the ink in the pressure chambers; and a common circulation flow path with which at least two of the discrete circulation flow paths communicate; and a common supply liquid chamber that is provided on an upper surface of the head chip, and stores ink to be commonly supplied to the respective pressure chambers through a plurality of ink supply holes formed in the upper surface of the head chip;

wherein the plurality of pressure chambers are located vertically between the plurality of nozzles and the common supply liquid chamber.

2. The ink jet head according to claim 1, wherein the discrete circulation flow paths branch from portions located between end portions of the pressure chambers on outlet sides and the outlets of the nozzles in the ink flow paths.

3. The ink jet head according to claim 2, wherein the ink flow paths include communicating paths through which the nozzles communicate with the pressure chambers, and the discrete circulation flow paths branch from the communicating paths.

4. The ink jet head according to claim 2, wherein the common circulation flow path and the pressure chambers are provided in positions that at least partially overlap in a direction of ink ejection from the nozzles.

5. The ink jet head according to claim 2, wherein the nozzles are arranged in a plurality of rows, and the common circulation flow path is provided for every row or every other row of the rows of the nozzles.

6. The ink jet head according to claim 2, further comprising a first damper that is provided to face at least one of the discrete circulation flow paths and the common circulation flow path, and are capable of changing volumes of flow paths when being elastically deformed by pressure.

7. The ink jet head according to claim 2, further comprising a first damper that is provided to face at least one of an upper portion and a lower portion of the common circulation flow path, and are capable of changing volumes of flow paths when being elastically deformed by pressure, wherein the first damper has an air chamber on the opposite side from the common circulation flow path, the air chamber facing the first damper.

8. The ink jet head according to claim 2, further comprising a second damper that is provided to face the common supply liquid chamber, and are capable of changing a volume of the common supply liquid chamber when being elastically deformed by pressure.

9. An ink jet recording apparatus comprising:

the ink jet head according to claim 2; and a circulator that generates circulation flows from the ink flow paths to the discrete circulation flow paths.

10. The ink jet head according to claim 1, wherein the ink flow paths include communicating paths through which the nozzles communicate with the pressure chambers, and the discrete circulation flow paths branch from the communicating paths.

11. The ink jet head according to claim 10, wherein the common circulation flow path and the pressure chambers are provided in positions that at least partially overlap in a direction of ink ejection from the nozzles.

12. The ink jet head according to claim 10, wherein
the nozzles are arranged in a plurality of rows, and
the common circulation flow path is provided for every row or every other row of the rows of the nozzles.

13. The ink jet head according to claim 10, further comprising
a first damper that is provided to face at least one of the discrete circulation flow paths and the common circulation flow path, and are capable of changing volumes of flow paths when being elastically deformed by pressure.

14. The ink jet head according to claim 13, wherein the head chip comprises:
a nozzle substrate comprising the plurality of nozzles;
a pressure chamber substrate comprising the plurality of pressure chambers; and
a common flow path substrate comprising the common circulation flow path;
wherein the head chip is formed by stacking the common flow path substrate between the nozzle substrate and the pressure chamber substrate.

15. The ink jet head of claim 14, wherein the common supply liquid chamber is provided at an upper portion of the pressure chamber substrate.

16. The ink jet head according to claim 10, further comprising
a first damper that is provided to face at least one of an upper portion and a lower portion of the common circulation flow path, and are capable of changing volumes of flow paths when being elastically deformed by pressure,
wherein the first damper has an air chamber on the opposite side from the common circulation flow path, the air chamber facing the first damper.

17. The ink jet head according to claim 1, wherein the common circulation flow path and the pressure chambers are provided in positions that at least partially overlap in a direction of ink ejection from the nozzles.

18. The ink jet head according to claim 1, wherein
the nozzles are arranged in a plurality of rows, and
the common circulation flow path is provided for every row or every other row of the rows of the nozzles.

19. The ink jet head according to claim 1, further comprising
a first damper that is provided to face at least one of the discrete circulation flow paths and the common circulation flow path, and are capable of changing volumes of flow paths when being elastically deformed by pressure.

20. The ink jet head according to claim 1, further comprising
a first damper that is provided to face at least one of an upper portion and a lower portion of the common circulation flow path, and are capable of changing volumes of flow paths when being elastically deformed by pressure,
wherein the first damper has an air chamber on the opposite side from the common circulation flow path, the air chamber facing the first damper.

21. The ink jet head according to claim 1, further comprising
a second damper that is provided to face the common supply liquid chamber, and are capable of changing a volume of the common supply liquid chamber when being elastically deformed by pressure.

22. An ink jet recording apparatus comprising:
the ink jet head according to claim 1; and
a circulating means that generates circulation flows from the ink flow paths to the discrete circulation flow paths.

* * * * *